US007885594B2

(12) United States Patent
Fujii

(10) Patent No.: US 7,885,594 B2
(45) Date of Patent: Feb. 8, 2011

(54) IMAGE FORMING APPARATUS WITH TONER REMOVING BLADE

(75) Inventor: Hirokazu Fujii, Osaka (JP)

(73) Assignee: Kyocera Mita Corporation (JP)

( * ) Notice: Subject to any disclaimer, the term of this patent is extended or adjusted under 35 U.S.C. 154(b) by 60 days.

(21) Appl. No.: 12/427,152

(22) Filed: Apr. 21, 2009

(65) Prior Publication Data

US 2009/0269106 A1 Oct. 29, 2009

(30) Foreign Application Priority Data

Apr. 24, 2008 (JP) ..... 2008-113619

(51) Int. Cl.
*G03G 21/00* (2006.01)

(52) U.S. Cl. ..... 399/343; 399/102

(58) Field of Classification Search ..... 399/343, 399/349, 102

See application file for complete search history.

(56) References Cited

U.S. PATENT DOCUMENTS 6,044,235 A * 3/2000 Hashimoto ..... 399/343 X
6,173,137 B1 * 1/2001 Zona ..... 399/343 X
6,895,198 B2 * 5/2005 Thompson et al. ..... 399/102
2003/0156870 A1 * 8/2003 Byun et al. ..... 399/356

FOREIGN PATENT DOCUMENTS

JP 1-297685 11/1989
JP 11-119548 A * 4/1999

* cited by examiner

*Primary Examiner*—Sophia S Chen
(74) *Attorney, Agent, or Firm*—Gerald E. Hespos; Michael J. Porco

(57) ABSTRACT

An image forming apparatus has a spacer roller that contacts a photosensitive drum outside a running region of a transfer member. The spacer roller forms a gap between a developing roller and the photosensitive drum. A cleaning device is positioned at downstream side of a nip position formed between the photosensitive drum and the transfer member. A toner removing blade is disposed between the downstream side of the nip and an upstream side of the cleaning device. The toner removing blade has a contact portion that contacts a contact region between the photosensitive drum and the spacer roller. The rotation axis of the photosensitive drum extends along an inner end of the contact portion. This inner end of the contact portion is positioned within a toner collecting region in which toner is scraped off by the cleaning device.

7 Claims, 11 Drawing Sheets

IMAGE FORMING APPARATUS WITH TONER REMOVING BLADE

BACKGROUND OF THE INVENTION

1. Field of the Invention

The present invention relates to an image forming apparatus, and particularly to an electrophotographic image forming apparatus such as a copier, a printer, a fax machine or a multifunction machine comprising these apparatuses.

2. Description of the Related Art

Electrophotographic image forming apparatuses conduct following process. An electrostatic latent image is formed on the surface of a photosensitive drum. Toner is then supplied onto the surface of the photosensitive drum by a developing roller of a developing device to develop the electrostatic latent image on the surface of the photosensitive drum into a toner image (development). The toner image on the photosensitive drum is transferred onto a sheet such as copy paper, plastic sheets for OHP, and the like. Finally the sheet having the toner image formed thereon is heated and pressed, as a result of which the toner image becomes fixed to the paper.

In such image forming apparatuses, as illustrated in FIG. 11, a spacer roller 103 that is concentric with the axis C1 of a developing roller 102 is mounted on both ends of the developing roller 102 along the direction in which the axis C1 of a developing roller 102 extends (at a region outside the width of a transfer member), in order to maintain a suitable gap between a photosensitive drum 101 and the developing roller 102, and to prevent occurrence of uneven development. The outer periphery of the spacer roller 103 is pushed against the outer peripheral face of the photosensitive drum 101 in such a manner that a suitable gap is maintained between the developing roller 102 and the photosensitive drum 101.

However, when toner floating in the environment around the photosensitive drum 101 and the developing roller 102 adheres to a contact region 105 of the spacer roller 103 and the photosensitive drum 101 in an image forming apparatus 104 such as the one illustrated in FIG. 11, the toner adhered is compressed by the rotating spacer roller 103 and fixed onto the outer peripheral face of the photosensitive drum 101 in the form of a ring-like toner layer. This diminishes maintaining a constant gap between the axes of the developing roller 102 and the photosensitive drum 101, and may give rise to uneven development (jitter).

To solve the above problem, an image forming apparatus 110 illustrated in FIG. 12 has mounted therein toner removing blades (blade pieces) 111 that slide against the surface of a photosensitive drum 114, for scraping the ring-like toner layer off. The toner removing blades 111 are positioned at downstream relating to a cleaning blade 113 of a cleaning device 112 in respect to a rotation direction of the photosensitive drum 114. Examples of this conventional feature are disclosed in, for instance, Japanese Patent Application Laid-open No. 1-297685.

The conventional image forming apparatus 110 illustrated in FIG. 12, however, does not accord sufficient consideration to collection of toner dust that is scraped off by the toner removing blades 111. As a result, the toner dust scraped off by the toner removing blades 111 may adhere onto the photosensitive drum 114 within an effective development width region of the latter. This may result in a new problem in that the toner dust upsets the toner image formed on the surface of the photosensitive drum 114.

SUMMARY OF THE INVENTION

Accordingly, it is an object of the present invention to provide an image forming apparatus that can form good images without uneven development.

A preferred aspect of the present invention is an image forming apparatus for forming a toner image based on an electrostatic latent image, comprising: a photosensitive drum with a surface on which the electrostatic latent image is formed; a developing device that supplies toner to the photosensitive drum via a developing roller, and that forms a toner image on the surface of the photosensitive drum; a transfer member that forms a nip with the photosensitive drum; a spacer roller that is disposed concentrically with a rotation axis of the developing roller, that contacts with the photosensitive drum outside a running region of the transfer member, and that forms a predetermined gap between the developing roller and the photosensitive drum; a cleaning device that is positioned at downstream side of a nip position with respect to the rotational direction of the photosensitive drum, and that clean the toner remaining on the surface of the photosensitive drum; and a toner removing blade that is provided in the cleaning device, that is disposed at downstream side of the nip position, and upstream side of the cleaning device, with respect to the rotational direction of the photosensitive drum, and that contacts with a contact region between the photosensitive drum and the spacer roller. The toner removing blade includes a contact portion that contacts with the contact region in such a manner that an inner end of the contact portion, which along the rotation axis of the photosensitive drum extends, is positioned within a toner collecting region in which toner is scraped off by the cleaning device.

In this preferable mode, any toner that becomes adhered, ring-like, onto the contact region of the spacer roller and the photosensitive drum can be scraped off by the toner removing blade, the toner scraped off being then collected by the cleaning device disposed downstream of the toner removing blade. This prevents the toner scraped off the surface of the photosensitive drum from adhering again onto the photosensitive drum within an effective development width region of the latter, and therefore preventing the occurrence of uneven development.

Other objects, features and effects of the present invention will be explained in further detail below on the basis of embodiments, with reference to accompanying drawings.

BRIEF DESCRIPTION OF DRAWINGS

FIG. 9 is a set of external perspective-view diagrams of a toner removing blade of the image forming apparatus of FIG. 1.

DETAILED DESCRIPTION OF THE PREFERRED EMBODIMENTS

Figure 1:
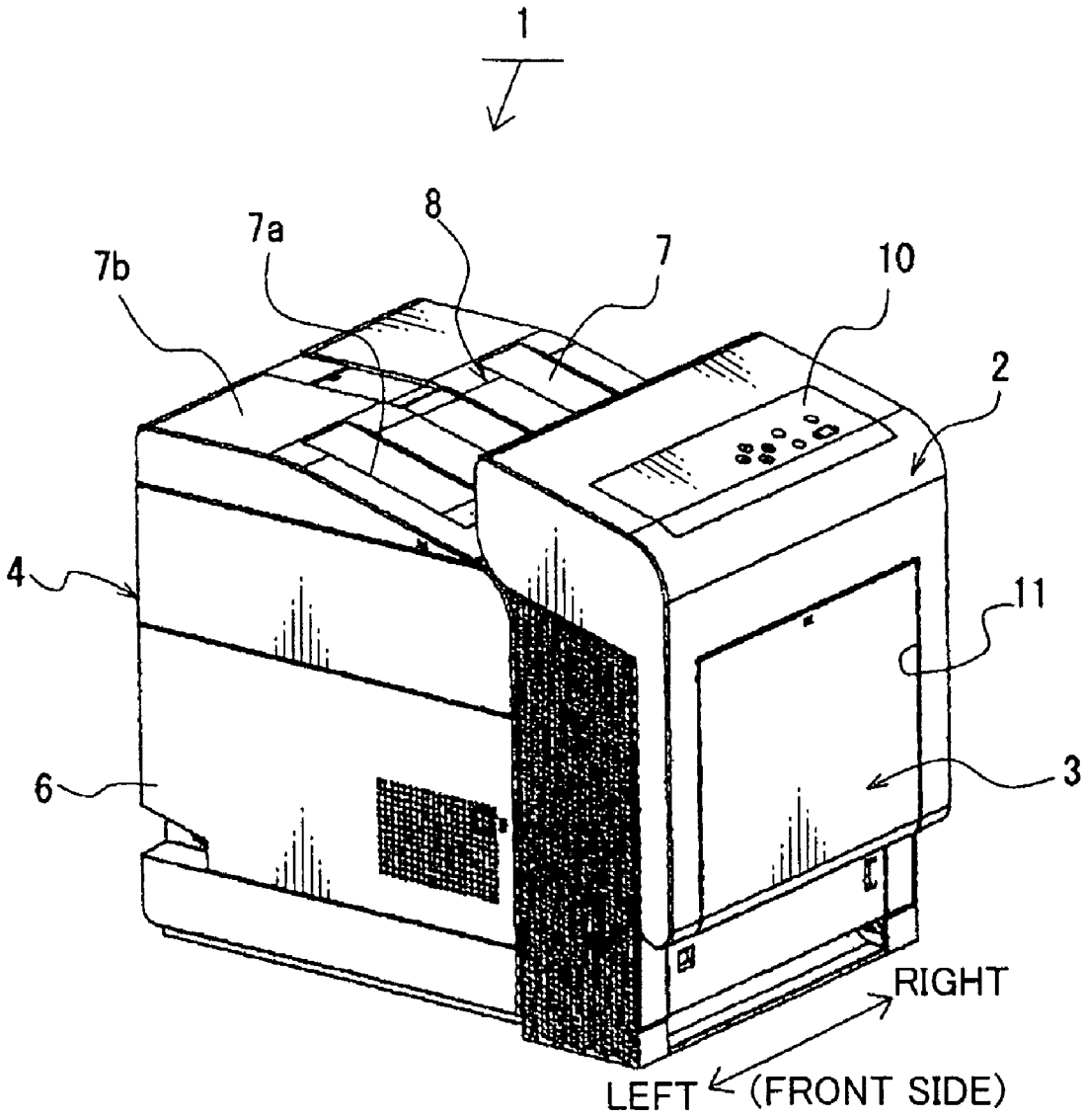
FIG. 1 is a perspective-view diagram of an entire image forming apparatus according to an embodiment of the present invention as viewed obliquely from above at a position to the front and left.

Preferred embodiments of the present invention are explained below with reference to accompanying drawings. In the drawings, elements denoted by identical reference numerals are identical elements, and redundant explanations thereof are omitted as the case may require. Moreover, elements and so forth not required for the explanation are expunged from the drawings.

(Schematic Configuration of the Image Forming Apparatus)

Figure 2:
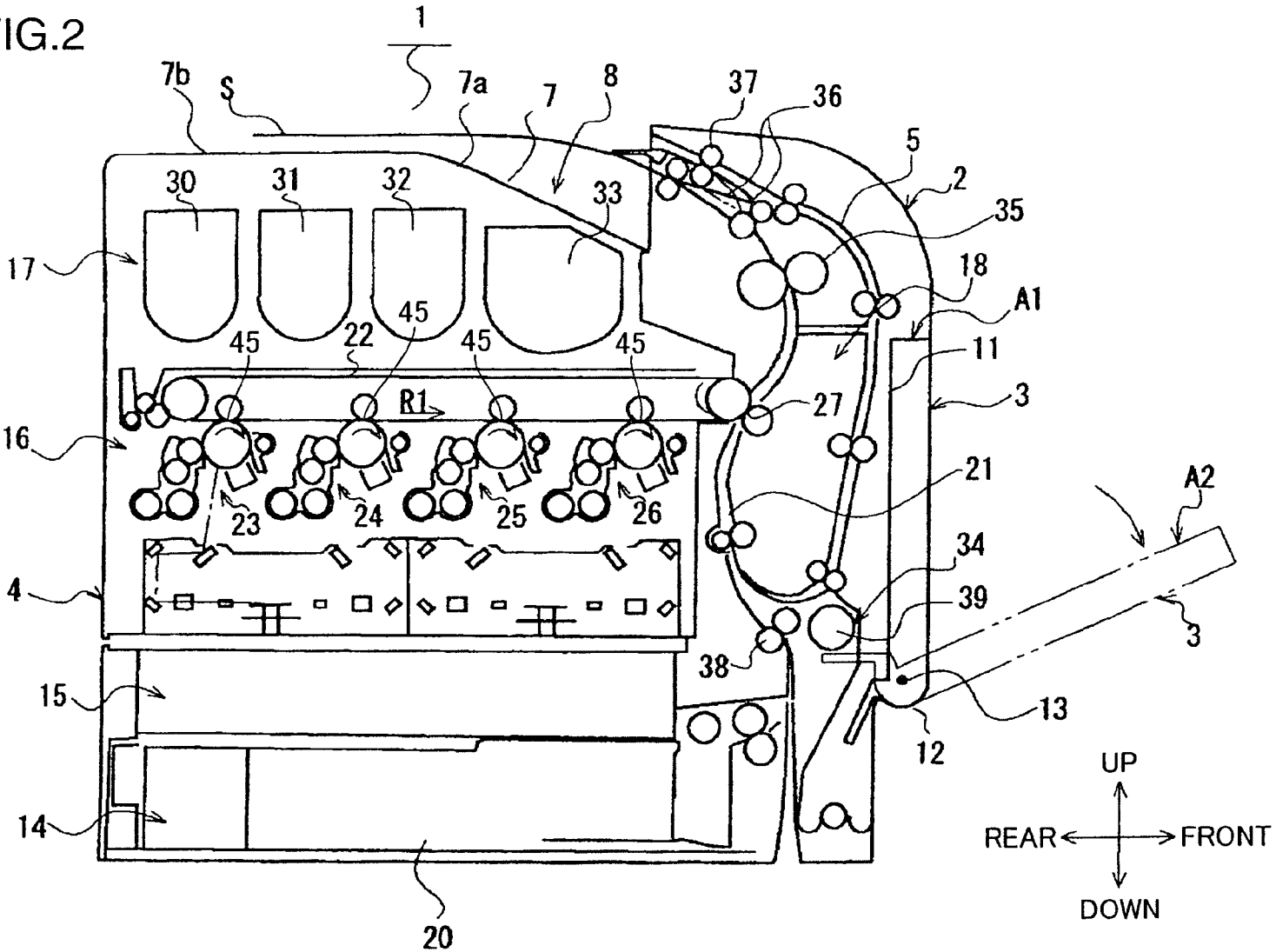
FIG. 2 is a diagram illustrating schematically the inner structure of the image forming apparatus of FIG. 1 as viewed from the left.

FIGS. 1 and 2 are diagrams for explaining the schematic configuration of an image forming apparatus 1 according to the present embodiment. FIG. 1 is a perspective-view diagram of the entire image forming apparatus 1 as viewed obliquely from above at a position to the front and left of the image forming apparatus 1. FIG. 2 is a diagram illustrating schematically the inner structure of the image forming apparatus 1 as viewed from the left.

The image forming apparatus 1 may be a copier, a fax machine, a printer, or a multifunction machine comprising the foregoing. The explanation of the image forming apparatus 1 will be based on an example of a printer. The image forming apparatus 1 illustrated in FIGS. 1 and 2 is a four-color full-color image forming apparatus 1 of electrophotographic type, intermediate transfer type or tandem type.

The overall configuration of the image forming apparatus 1 viewed from outside will be explained with reference to FIGS. 1 and 2. The image forming apparatus 1 is provided with a substantially box-like (rectangular parallelepiped) image forming apparatus body 4, and a front cover 2 which is openably and closably (swingably) supported on the image forming apparatus body 4.

The open portions (sheet transport paths) 21 and 5 on the front side of the image forming apparatus body 4 are covered by the front cover 2. The left and side faces are covered by a left and outer panel 6 and a right outer panel (not shown) made of synthetic resin (FIG. 2). A paper output tray 8 having a sheet stacking surface 7 is disposed at the top face of the image forming apparatus body 4. The sheet stacking surface 7 is provided with an inclined surface 7*a* slanting gently in such a manner that the rear end thereof stands at a higher position, and a flat surface 7*b* continuous to the rear end of the inclined surface 7*a*. After image formation, the sheets outputted rearwards out of a below-described sheet output opening (not shown) are supported from below by the sheet stacking surface 7. When a paper jam occurs along the sheet transport path 21 or 5, a lock mechanism not shown that fastens the front cover 2 to the image forming apparatus body 4 is released and the front cover 2 is swung open, whereupon the open portions (sheet transport paths) 21 and 5 on the front side of the image forming apparatus body 4 can be exposed to the exterior, thereby allowing to get rid of the jammed sheets S at the sheet transport path 21 or 5 (FIG. 2).

As illustrated in FIG. 1, an operation panel 10 is disposed at the top end of the front cover 2. A touch panel-type liquid crystal display device and various buttons are disposed on the operation panel 10. Operators (for instance, users or service engineers) can operate the entire image forming apparatus 1 via the operation panel 10 while standing in front (front side) of the image forming apparatus 1.

A manual tray 3 is swingably mounted into a recess 11 on a front side (outer front side) of the front cover 2. The manual feed tray 3 housed in the recess 11 of the front cover 2 can be swung out from a stored position A1 to a paper feeding position A2 (FIG. 2). As illustrated in FIG. 2, the manual tray 3 has a support shaft 13 that is swingably supported in a shaft hole, not shown, of the front cover 2, at a base 12 positioned at the lower end of the manual tray 3.

Now, with reference to FIG. 2, the internal structure of the image forming apparatus 1 will be explained.

As illustrated in FIG. 2, the image forming apparatus 1 provided in the image forming apparatus body 4 with a sheet storage portion 14, a board housing portion 15, an image forming unit 16, a toner replenishing portion 17, and a paper output tray 8 which are disposed in aforementioned order from the bottom. A sheet transport portion 18 is provided between the front side of the image forming apparatus body 4 and the front cover 2.

A paper feeding cassette 20 is disposed in the sheet storage portion 14. The paper feeding cassette 20 feeds individual sheets separate from a plurality of sheets stacked inside of the paper feeding cassette 20 to the sheet transport path 21.

A circuit board, electronic components and the like (not shown) for controlling the entire image forming apparatus 1 are disposed in the board storage portion 15. The image forming unit 16 is disposed above the board housing portion 15.

The image forming unit 16 includes an endless intermediate transfer belt 22, and four image forming units (for four colors) arrayed along the rotation direction (direction of arrow R1) of the intermediate transfer belt 22. The image forming units include image forming units 23, 24, 25, and 26 for forming toner images of respective colors, namely magenta (M), cyan (C), yellow (Y), and black (K).

In the toner replenishing portion 17, there are disposed four toner containers 30, 31, 32, and 33 having each stored therein toner of a respective color, namely, magenta, cyan, yellow, and black.

In the present embodiment, the sheet transport portion 18 is disposed between the front side of the image forming apparatus body 4 and the front cover 2. The sheet transport portion 18 is provided with the sheet transport path 21 that guides sheets from the bottom upwards, the sheet transport path 5 disposed further to the front than the sheet transport path 21 and guides sheets from the top downwards, and a manual feeding portion 34.

The intermediate transfer belt 22, which is an example of the transfer member of the present invention, is a toner image carrier embodied, for instance, in the form of a belt resulting from bonding two overlapping ends of a sheet material made of a dielectric resin or a belt having no joint lines (seamless belt). The intermediate transfer belt 22 is disposed above the image forming unit 16 and is configured in such a manner so as to revolve contacting with photosensitive drums 40 (FIG. 5) that are equipped with the respective image forming units 23 to 26. In the present embodiment, the toner images from each photosensitive drum 40 (FIG. 5) of the respective image forming unit 23 to 26 are transferred onto the intermediate transfer belt 22 in superposed manner (primary transfer). As a result of this primary transfer, a color toner image is formed on the intermediate transfer belt 22. The nips 45 formed between each image forming unit 23 to 26 and the intermediate transfer belt 22 will also be called nip positions (or primary transfer positions) in the explanation hereafter. The intermediate transfer belt 22 also forms a nip 27 with the sheet transport path 21. The nip 27 is located at, in the revolving direction of the intermediate transfer belt 22, a downstream position of the image forming unit that stands furthest downstream among the group of image forming units 23 to 26. The toner image primary-transferred from the group of image forming units 23 to 26 is in turn transferred to a sheet (secondary transfer) at this nip 27. The nip 27 at which the toner image is secondarily transferred to a sheet will also be referred to as the secondary transfer position in the explanation hereafter.

A fixing device 35 is disposed at the sheet transport path 21 at a downstream side of the secondary transfer position 27 in the sheet transport direction. There are two alternative transmissions of sheet S having the toner image fixed thereon by the fixing device 35. In one alternative, the sheet S is guided onto the paper output tray 8. The other alternative, the sheet S is guided toward the sheet transport path 5 (sheet re-transport path for two-side printing). During two-side printing, the sheet having been transported through the sheet transport path 21 is guided into a flapper 36. The rear end of the sheet will be held by reversing rollers 37 which guide the sheet back from the top into the sheet transport path 21 downwardly. A manual feeding roller 39 is disposed immediately in front of a transport roller pair 38 at the sheet transport portion 18. The manual feeding roller 39 feeds the sheets that are set on the top face of the manual tray 3, in an open state (i.e. at the paper feeding position A2) as denoted by the double-dotted line of FIG. 2, towards the transport roller pair 38.

(Image Forming Unit)

Figure 3:
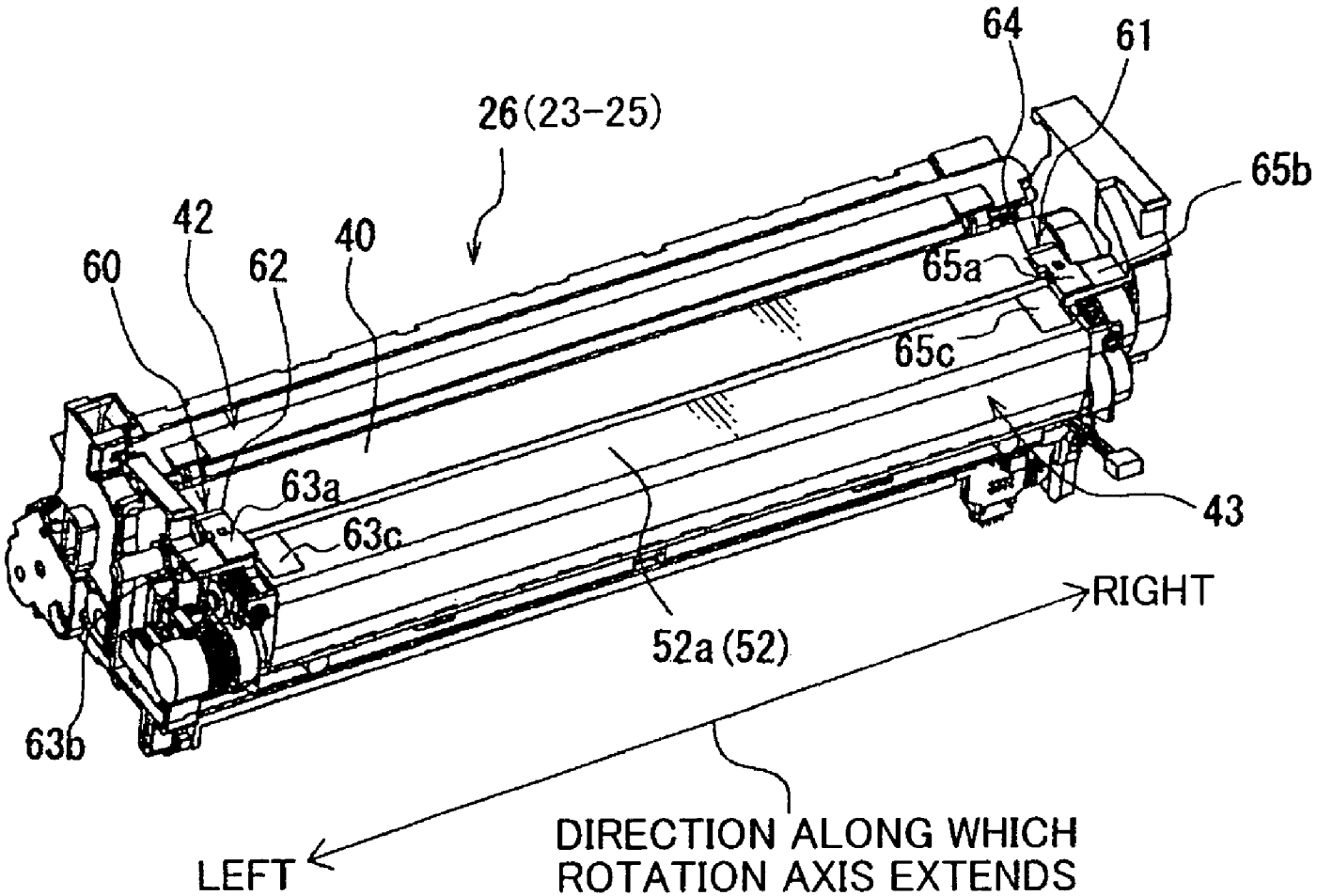
FIG. 3 is an external perspective-view diagram of an image forming unit of the image forming apparatus of FIG. 1, as viewed obliquely from above.
Figure 4:
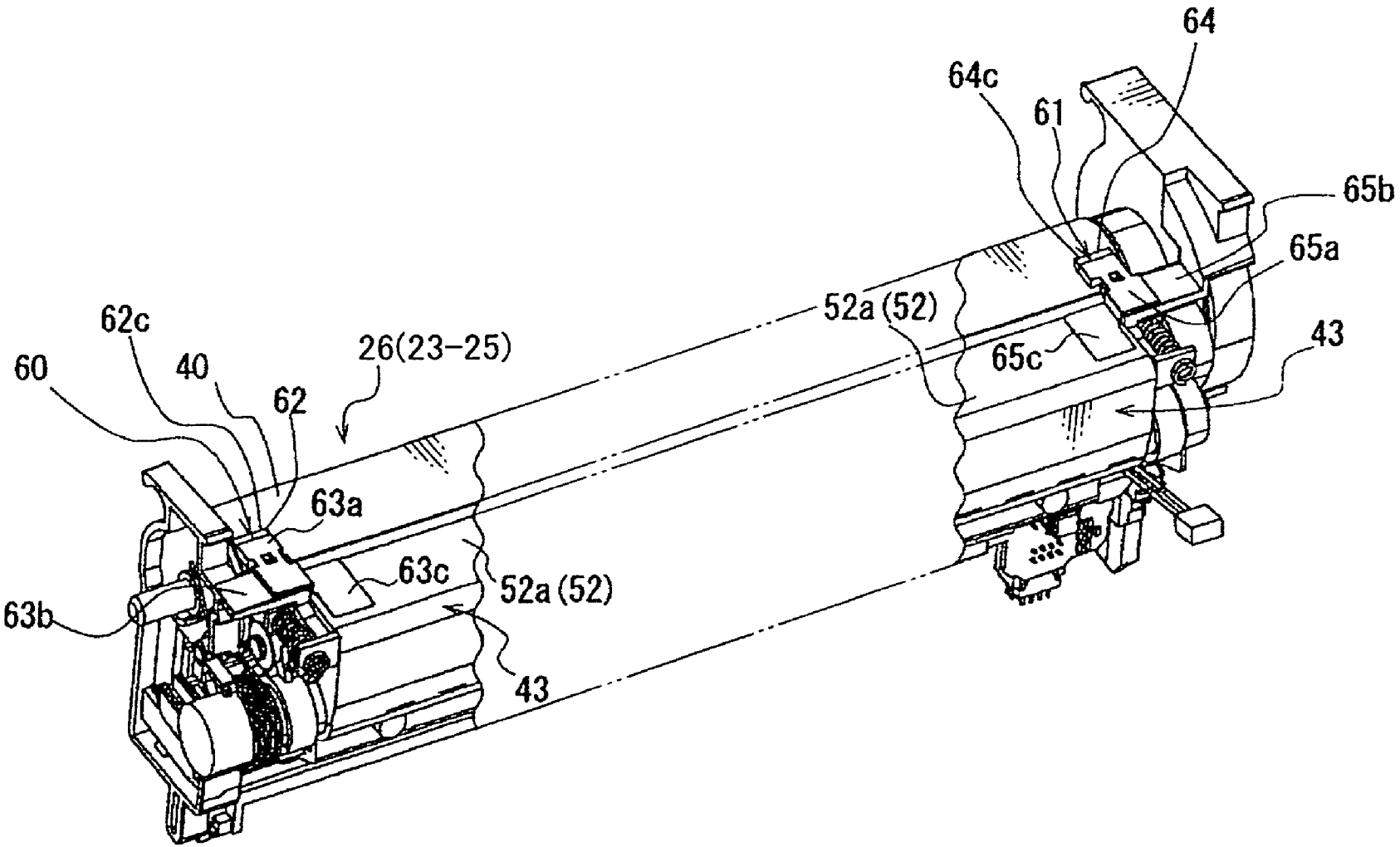
FIG. 4 is a perspective-view diagram illustrating an enlarged section of the image forming unit depicted in FIG. 3 in the vicinity of two end portions.
Figure 5:
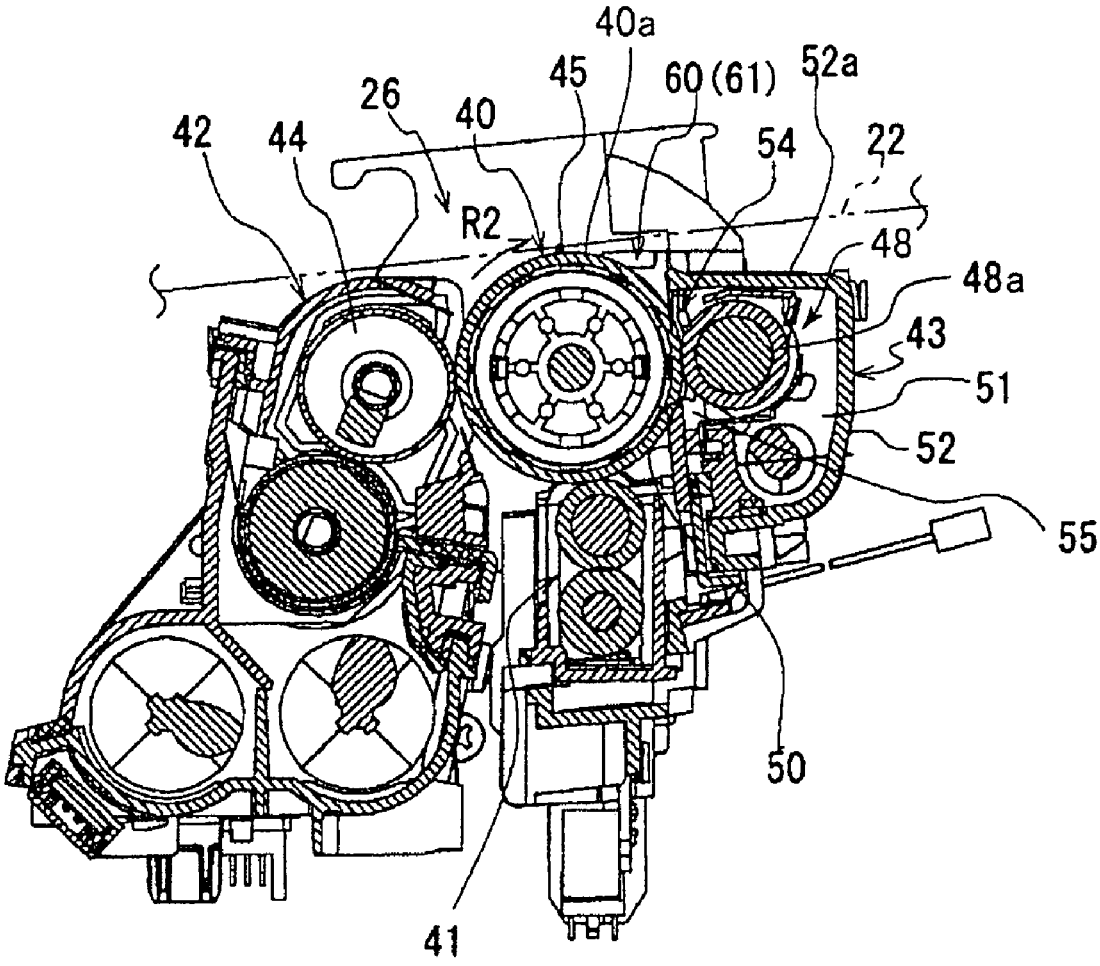
FIG. 5 is a cross-sectional diagram of the image forming unit illustrated in FIG. 3 along a cross section perpendicular to the rotation axis of a photosensitive drum.

FIGS. 3 to 5 are diagrams illustrating an example of a black (K) image forming unit 26 from among the four (four colors) image forming units 23 to 26. FIG. 3 is an external perspective-view diagram of the image forming unit 26 as viewed obliquely from above. FIG. 4 is a perspective-view diagram illustrating an enlarged section of the image forming unit 26 illustrated in FIG. 3. FIG. 5 is a cross-sectional diagram illustrating the image forming unit 26 sliced along a hypothetical plane that is perpendicular to the direction along which the rotation axis of a photosensitive drum 40 extends.

As shown in FIGS. 3 to 5, the image forming unit 26 is provided with a substantially tubular photosensitive drum 40, a charging device 41, a developing device 42, a cleaning device 43, and so forth, which are arranged at the periphery of the photosensitive drum 40. The charging device 41, the developing device 42, and the cleaning device 43 are laid out in this order from the upstream side with respect to a rotation direction R2 of the photosensitive drum 40.

Among them, the photosensitive drum 40, which is formed of amorphous silicon (a-Si), is rotationally driven in the direction of the arrow R2 at a predefined process speed.

The charging device 41 charges uniformly (homogeneously) the surface of the photosensitive drum 40 to a predetermined polarity and potential.

A developing roller 44 of the developing device 42 supplies toner to the surface of the photosensitive drum 40, on which an electrostatic latent image has been formed by an exposure device not shown. As a result, the electrostatic latent image on the surface of the photosensitive drum 40 is developed into a toner image. The toner image formed thus on the surface of the photosensitive drum 40 is primary-transferred onto the intermediate transfer belt 22 at the nip position 45.

Figure 6:
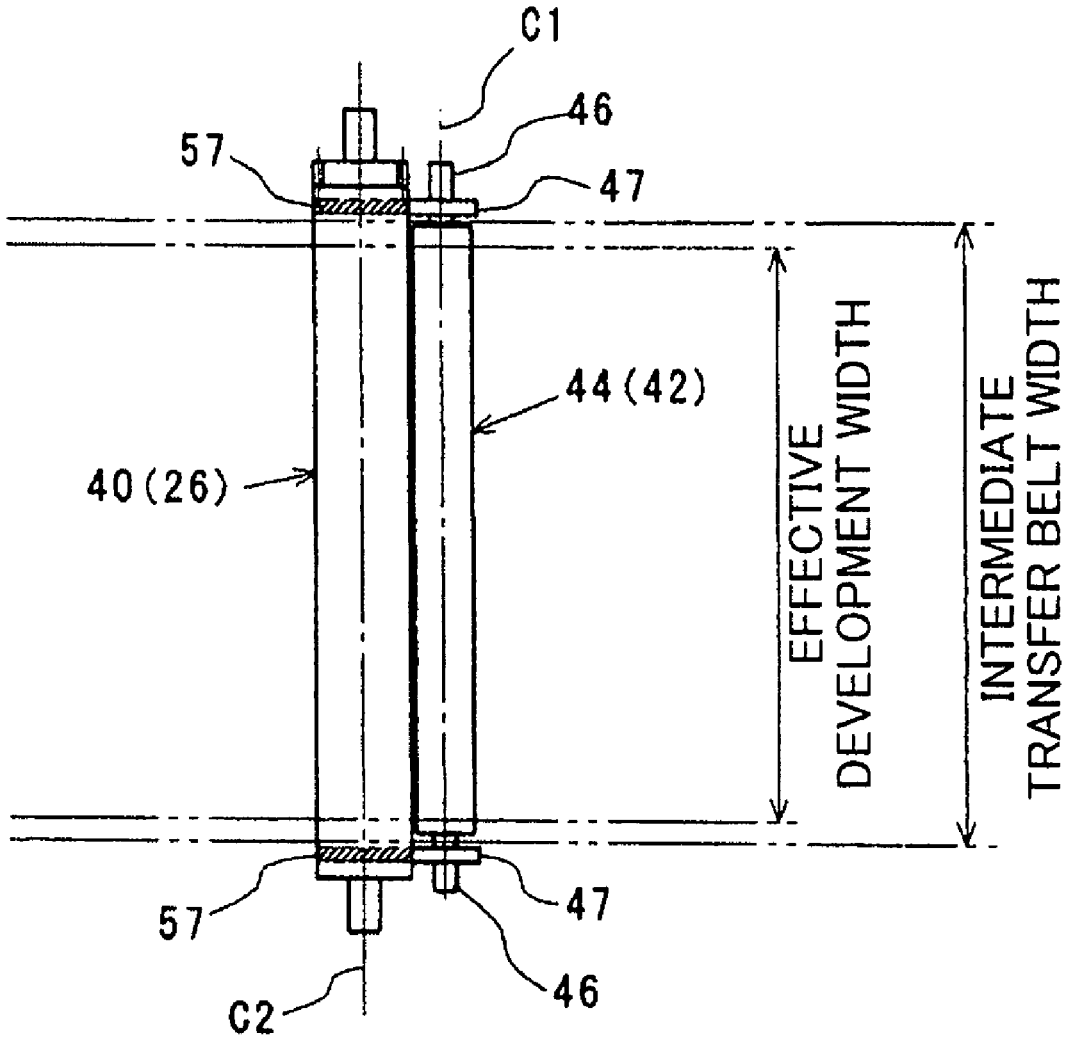
FIG. 6 is a diagram illustrating schematically a spacer roller mounted on a developing roller of the image forming apparatus of FIG. 1, when in contact with a photosensitive drum.
Figure 7:
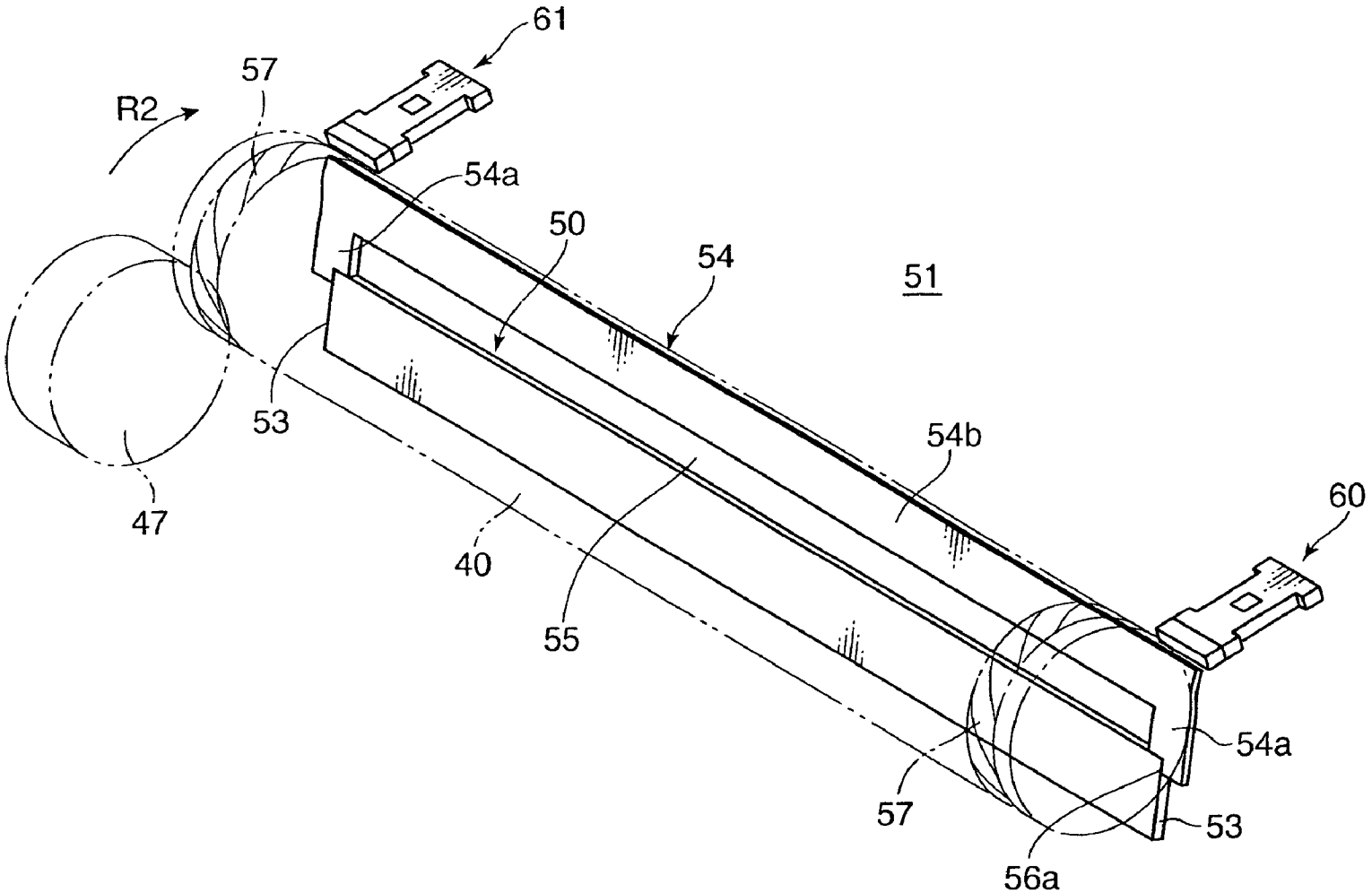
FIG. 7 is a perspective-view diagram illustrating in a simplified manner a relevant portion of the image forming apparatus of FIG. 1.

As illustrated in FIGS. 6 and 7, the developing roller 44 of the developing device 42 is provided with shafts 46 projecting beyond the transfer member width, i.e. outside the running region of the intermediate transfer belt 22 at both ends of a rotation axis C1 of the developing roller 44, and spacer rollers 47 mounted on the shafts 46, all of which are concentric with the rotation axis C1. As illustrated in FIG. 6, the spacer rollers 47 are in contact with the outer peripheral face of the rotating photosensitive drum 40, to preserve an adequate distance between the developing roller 44 and the photosensitive drum 40 (by creating a predetermined gap between the developing roller 44 and the photosensitive drum 40), and prevent occurrence of uneven development. The regions illustrated in FIGS. 6 and 7, namely the ring-shaped locations at which the spacer rollers 47 come into contact with the photosensitive drum 40 are also referred to as contact regions 57 in the explanation hereafter.

With reference to FIGS. 3-7, the cleaning device 43 has (1) a friction roller 48 sliding against the surface of the photosensitive drum 40; (2) a cleaning blade 50 positioned at downstream relating to the contact position of the friction roller 48 and the photosensitive drum 40 in respect to a rotation direction R2 of the photosensitive drum 40, for scraping off residual toner on the surface of the photosensitive drum 40; (3) a housing 52 having an inner space 51, for collecting the toner scraped off by the cleaning blade 50, such that the roller 48 can be rotatably housed in the inner space 51; and (4) a seal 54 mounted at an opening 55 of the housing 52 which is close contacting with outer faces 53 and 53 at both ends of the cleaning blade 50 in the longitudinal direction thereof (both ends of the rotation axis C2 of the photosensitive drum 40). The seal 54 guides toner scraped off the surface of the photosensitive drum 40 by the cleaning blade 50 into the inner space 51 of the housing 52.

The cleaning device 43 removes and collects waste toner that still remained on the surface of the photosensitive drum 40 after the latter has passed the nip position 45 (toner remaining on the surface of the photosensitive drum 40 without having undergone primary transfer).

With reference to FIG. 5, the friction roller 48 is disposed to contact with the photosensitive drum 40 in such a way that the axial direction of the friction roller 48 is substantially parallel with the axial direction of the photosensitive drum 40. A roller surface 48*a* is formed on the outer periphery of the friction roller 48.

The roller surface 48*a* is consisting of an elastic material such as a rubber material. By moving at a greater peripheral speed than a drum surface 40*a* of the photosensitive drum 40, the roller surface 48*a* slides frictionally against the drum surface 40*a*, cleaning thereby the latter.

As illustrated in FIG. 7, the cleaning blade 50 delimits the opening 55 of the housing 52 together with the seal 54, and scrapes off residual toner from the photosensitive drum 40 into the opening 55. In the present embodiment, the area at which the edge of the opening 55 is slide contacting with a peripheral face 40*a* of the photosensitive drum 40 delimits a toner collecting region.

Figure 8A:
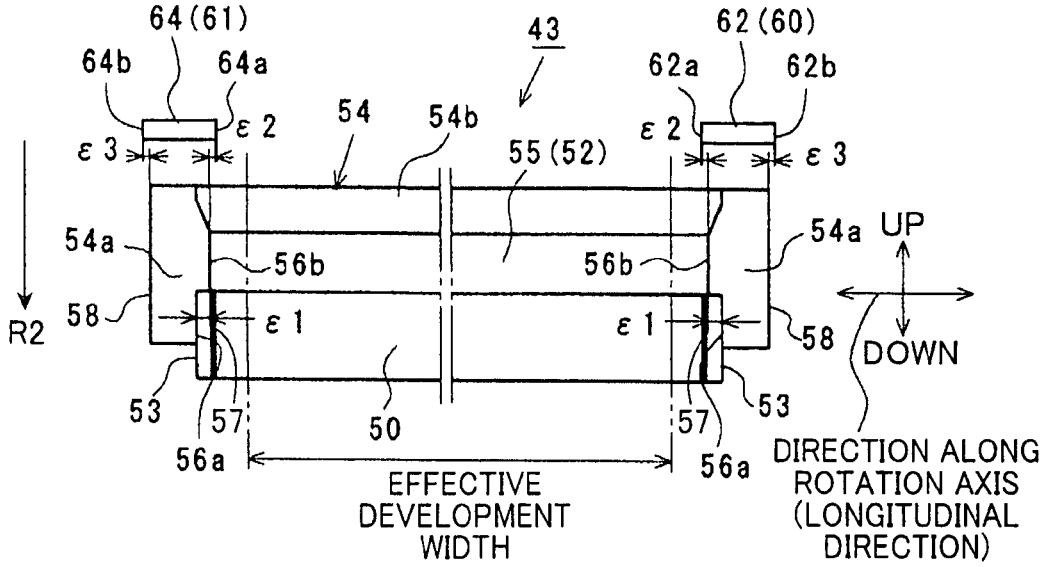
FIG. 8 is a diagram illustrating the vicinity of a opening of a cleaning device in an image forming apparatus according to the present invention, viewed from the side of the photosensitive drum, in which FIG. 8A corresponds to the example of FIG. 1 and FIG. 8B corresponds to a modification thereof.

FIG. 8A is a diagram illustrating the relationship between the cleaning blade 50 and the seal 54 of the cleaning device 43 as viewed from the side of the photosensitive drum 40.

As illustrated in FIG. 8A, the seal 54 has an overall gate-like outer appearance. The seal 54 has first seal portions 54*a* disposed as a hanging-down pair at both ends in the longitudinal direction of the cleaning blade 50, and a second seal portion 54*b*, formed integrally with the first seal portions 54*a* so as to connect the base end sides of the first seal portions 54*a* (upstream end side in respect to a rotation direction illustrated in FIG. 8A being the rotation direction R2 of the photosensitive drum 40). The second seal portion 54*b* is mounted along the upstream-side edge of the opening 55 of the housing 52 and thus delimits the edge of the opening 55. The pair of first seal portions 54*a*, which has a bilaterally symmetrical shape, thus delimits two end faces of the opening 55.

The cleaning blade 50 is a rectangular member, extending in the longitudinal direction along the photosensitive drum 40. The cleaning blade 50 delimits the downstream-side edge of the opening 55 of the housing 52 (downstream in respect to a rotation direction R2 of the photosensitive drum 40). The cleaning blade 50 is fixed to the housing 52 in such a manner that both ends thereof fit closely into respective rectangular cutouts formed in the first seal portions 54*a*. First inner faces 56*a* of the cutouts formed in the first seal portions 54*a* are in close contact with the outer faces 53 at both ends of the cleaning blade 50 in the longitudinal direction thereof. Inner side faces 56*b*, which is positioned at upstream side of the first inner faces 56*a* of the first seal portions 54*a* in the rotation direction of the photosensitive drum 40, protrude inwardly beyond both ends of the cleaning blade 50 in the longitudinal direction along the rotation axis C2 of the photosensitive drum 40 with a distance ∈1. The inner faces 56*b* delimit the side edges of the opening 55. The above mentioned seal 54 slides against the surface of the photosensitive drum 40 at positions in the vicinity of the outer side of the cleaning blade 50 in the longitudinal direction of the latter, thereby preventing the toner scraped off by the cleaning blade 50 from leaking out of the housing 52.

As illustrated in FIG. 7, the cleaning device 43 is provided with toner removing blades 60 and 61 (FIG. 3 and FIG. 4). The toner removing blades 60 and 61, which form a pair, are each provided at a respective contact region 57 and 57 of the photosensitive drum 40. The toner removing blades 60 and 61 are provided between downstream side of a first transfer position 45 and upstream side of the opening 55, in respect to a rotation direction R2 of the photosensitive drum 40.

Figure 8B:
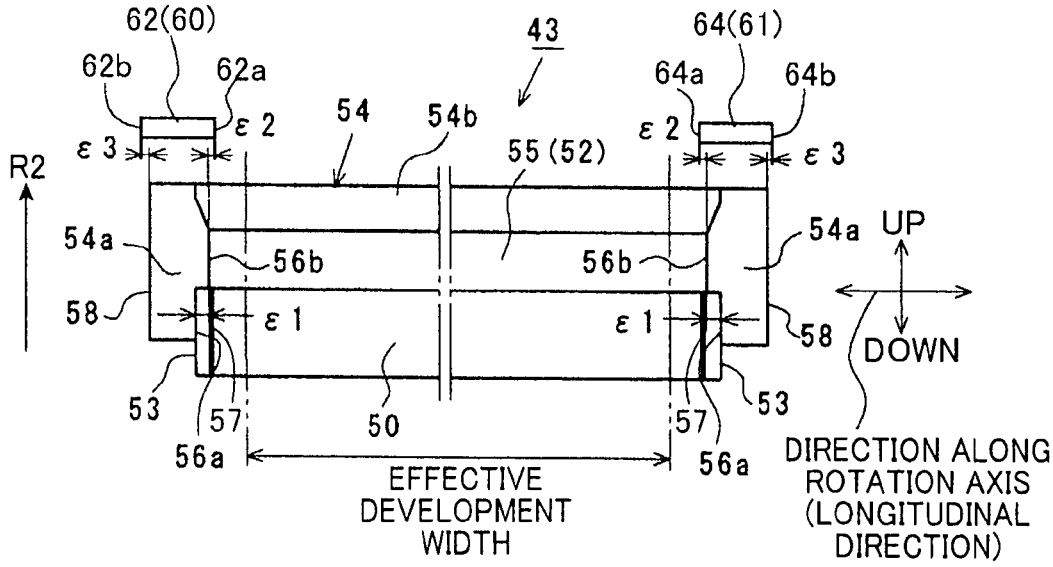
Figure 9C:
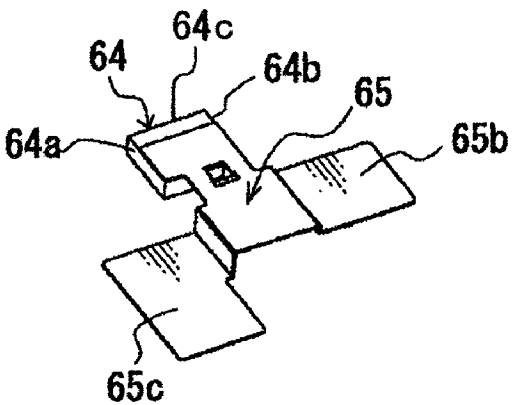
FIG. 9C is an external perspective-view diagram of the left toner removing blade in FIG. 3 as viewed obliquely from above and in front.
Figure 9D:
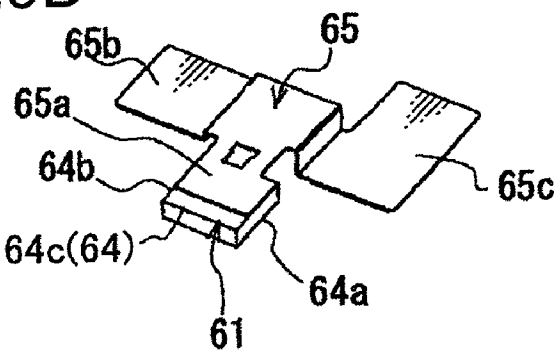
FIG. 9D is an external perspective-view diagram of the right toner removing blade in FIG. 3 as viewed obliquely from above and in front.
Figure 9A:
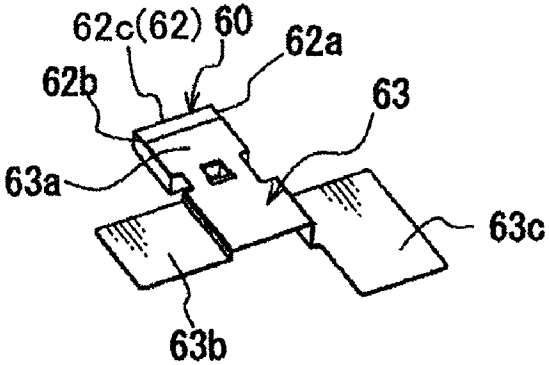
FIG. 9A is an external perspective-view diagram of a left toner removing blade in FIG. 3 as viewed obliquely from above and behind.
Figure 9B:
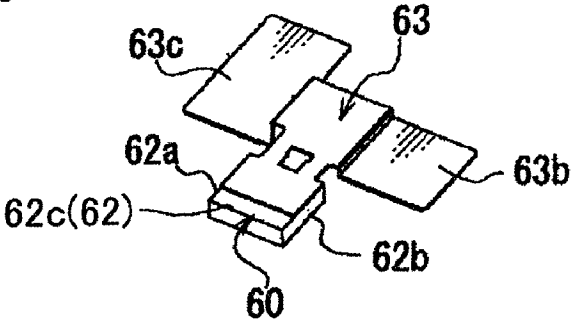
FIG. 9B is an external perspective-view diagram of a right toner removing blade in FIG. 3 as viewed obliquely from above and behind.

A modification of the seal and toner removing blades 60 and 61 illustrated in FIG. 8B may also be applied to the embodiment.

In FIG. 8B, the positional relationship between the cleaning blade 50 and the seal 54 differs from the above-described one in that the rotation direction of the photosensitive drum 40 is now reversed. Specifically, the cleaning blade 50 delimits now the upstream-side edge of the opening 55 (upstream in respect to a rotation direction R2 of the photosensitive drum 40). The second seal portion 54*b* that connects the base end sides of the pair of first seal portions 54*a* is disposed downstream in respect to a rotation direction R2 of the photosensitive drum 40, and delimits thus the downstream-side edge of the opening 55 (downstream in respect to a rotation direction of the photosensitive drum 40, i.e. the rotation direction illustrated in FIG. 8B). The pair of first seal portions 54*a*, having a bilaterally symmetrical shape, delimits the two end faces of the opening 55.

The present invention applies to both the configurations of FIGS. 8A and 8B.

As illustrated in FIGS. 9A to 9D, the planar shape of the toner removing blades 60 and 61 is bilaterally symmetrical. One of the blades or the left-side toner removing blade 60 is provided with a plate-like rubber blade 62 having a planar quadrangular shape, and a metal plate 63 fixed to the rubber blade 62 at portions other than the leading end side of the rubber blade 62, so as to leave the leading end side of the rubber blade 62 exposed. The metal plate 63 is provided with a base 63*a* that holds the rubber blade 62, and tongue-shaped fixing pieces 63*b* and 63*c* protruding at both sides of the base 63*a*. The exposed portion at the leading end side of the rubber blade 62 slides against a corresponding contact region 57 of the photosensitive drum 40. Meanwhile, the fixing pieces 63*b* and 63*c* of the metal plate 63 are fixed to an upper outer surface 52*a* of the housing 52 (FIGS. 3 and 4). An end face 62*c* of the rubber blade 62, which is disposed on the upstream side of the rotation direction of the photosensitive drum 40, extends along the longitudinal direction of the axis C2 of the photosensitive drum 40 (FIG. 4). As illustrated in FIG. 8, an inner face 62*a* of the rubber blade 62 is disposed so as to be positioned inward from a second inner face 56*b* of the first seal portion 54*a* by a distance ∈2, thereby positioning inward side of a corresponding contact region 57 of the cleaning blade 50 and the photosensitive drum 40 in the axial direction. As illustrated in FIG. 8, an outer surface 62*b* of the rubber blade 62 is positioned outward side of an outer face 58 of the first seal position 54*a* by a distance ∈3. The inner face 62*a* of the rubber blade 62 of the toner removing blade 60 is an the inner face that stands closer than the outer face 62*b* to the center of the rotation axis C2 of the photosensitive drum 40, with the outer face 62*b* being positioned close to the axis end portion of the rotation axis C2 of the photosensitive drum 40. In the rubber blade 62 of the toner removing blade 60 of the present embodiment, the inner face 62*a* is an inner end and the outer face 62*b* is an outer end. The inner faces (56*a*, 56*b*) and the outer faces 58 of the first seal portion 54*a* are defined in accordance with the definition of the inner face 62*a* and the outer face 62*b* of the rubber blade 62. The second inner faces 56*b* positioned at the innermost position within the first seal portion 54*a* constitute the inner edge of the seal 54.

The toner removing blade 61 on the left side of FIG. 8 is provided with a plate-like rubber blade 64 having a quadrangular planar shape, and a metal plate 65 fixed to the rubber blade 64 at portions other than the leading end side of the rubber blade 64, so as to leave the leading end side of the rubber blade 64 exposed. The metal plate 65 is provided with a base 65*a* that holds the rubber blade 64, and tongue-shaped fixing pieces 65*b*, 65*c* protruding at both sides of the base 65*a*. In the toner removing blade 61 having such a construction, the exposed portion at the leading end side of the rubber blade 64 slides against the outer peripheral face of the photosensitive drum 40, and the fixing pieces 65*b*, 65*c* of the metal plate 65 are fixed to the upper outer surface 52*a* of the housing 52 (FIGS. 3 and 4). An end face 64*c* of the rubber blade 64, on the upstream side of the rotation direction of the photosensitive drum 40, extends along the axial direction of the photosensitive drum 40 (FIG. 4). As illustrated in FIG. 8, an inner face 64*a* of the rubber blade 64 is disposed so as to be positioned inward from a second inner face 56*b* of the first seal portion 54*a* by a distance ∈2, and so as to be positioned within the contact region of the cleaning blade 50 and the photosensitive drum 40, i.e. within the toner collecting region. As illustrated in FIG. 8, an outer face 64*b* of the rubber blade 64 is positioned outward outer than an outer face 58 of the first seal position 54 by a distance ∈3. The inner face 64*a* of the rubber blade 64 of the toner removing blade 61 is an inner face that stands closer than the outer face 64*b* to the center of the rotation axis C2 of the photosensitive drum 40, with the outer face 64*b* being positioned close to the axis end portion of the rotation axis C2 of the photosensitive drum 40. In the rubber blade 64 of the toner removing blade 61 in the present embodiment, the inner face 64*a* is an inner end and the outer face 64*b* is an outer end.

Even when in the image forming unit 26 having the above construction toner scattering into the environment that surrounds the photosensitive drum 40 and the developing roller 44 becomes adhered, ring-like, onto the contact regions 57 of the spacer rollers 47 and the photosensitive drum 40, the toner can be scraped off downstream in respect to a rotation direction of the photosensitive drum 40, from the upstream side of the toner-recovering opening 55, by (the rubber blades 62 and 64 of) the toner removing blades 60 and 61. The toner scraped off can drop from the inner faces 62*a*, 64*a* of the toner removing blades 60 and 61 into the opening 55, and hence the first seal portions 54*a* and the cleaning blade 50 can reliably lead the toner into the inner space 51 of the housing 52.

In the image forming unit 26 of the present embodiment, the first seal portions 54*a* are positioned in the vicinity of the outer sides of the cleaning blade 50, in such a manner that the first seal portions 54*a* slide against the surface of the photosensitive drum 40. This allows preventing, as a result, that the residual toner scraped off the surface of the photosensitive drum 40 by the cleaning blade 50 should leak out of the cleaning device 43.

The image forming unit 26 of the present embodiment, thus, allows preventing that toner scraped off the surface of the photosensitive drum 40 should adhere again onto the photosensitive drum 40 within the effective development width region of the latter, and allows preventing the occurrence of uneven development.

The above embodiment has been exemplified on the basis of a black (K) image forming unit 26, but the features of the embodiment are identical for the image forming units 23, 24, and 25 that form magenta (M), cyan (C) and yellow (Y) color toner images.

(Modification of the Mounting of the Toner Removing Blades)

Figure 10:
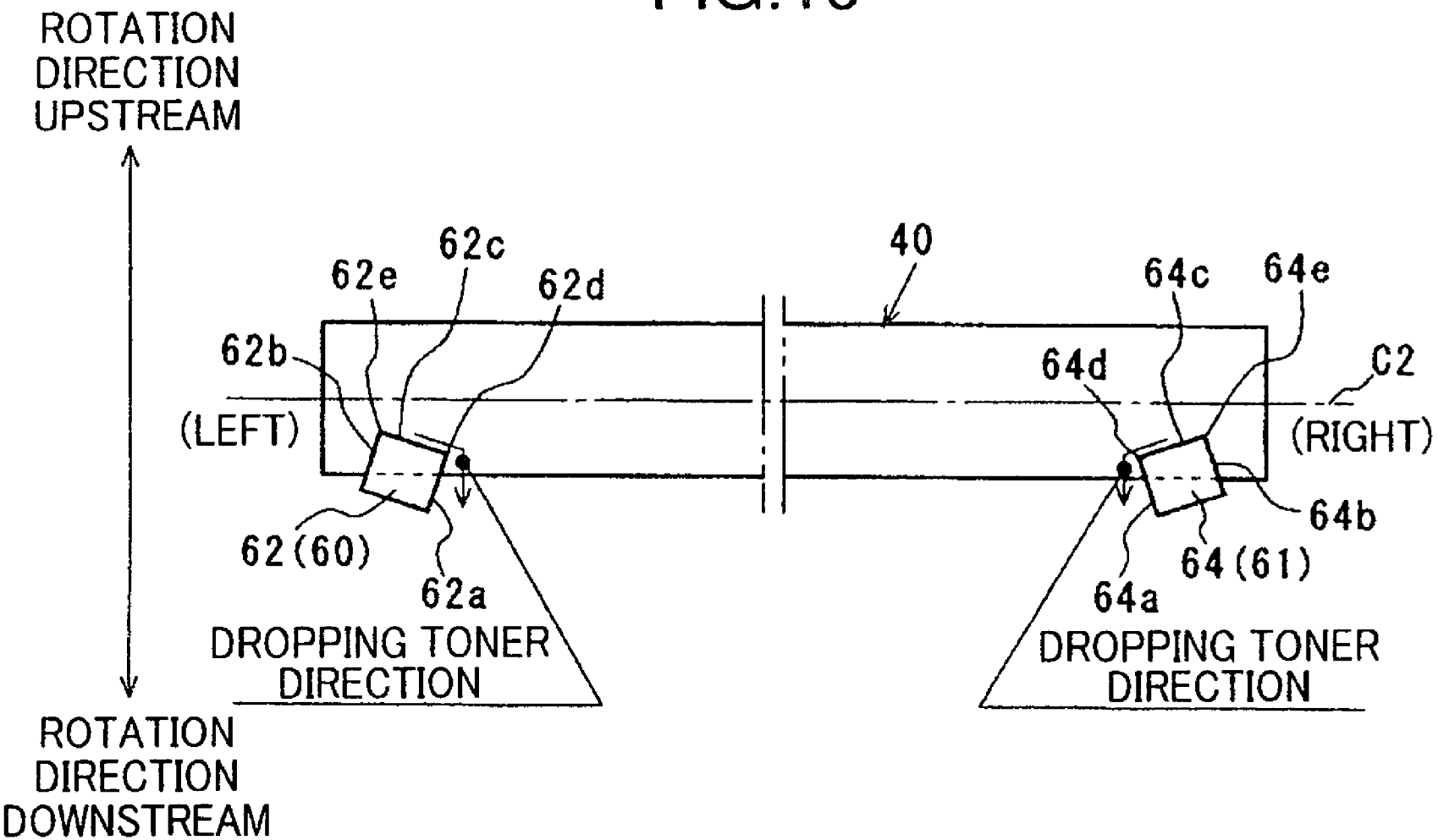
FIG. 10 is a diagram illustrating a modification of the mounted state of a toner removing blade according to an embodiment of the present invention.
Figure 11:
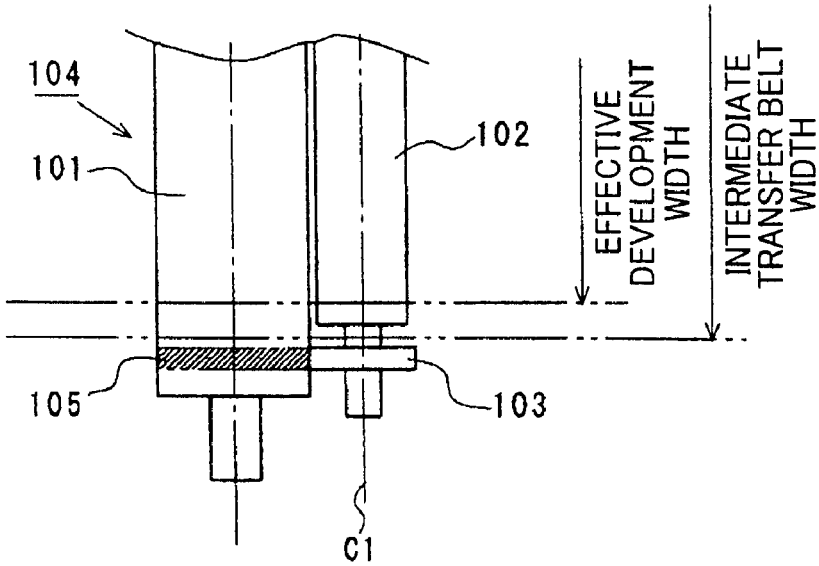
PRIOR ART FIG.11
FIG. 11 is a diagram illustrating the relationship between a photosensitive drum and a spacer roller of a developing roller in a conventional image forming apparatus.
Figure 12:
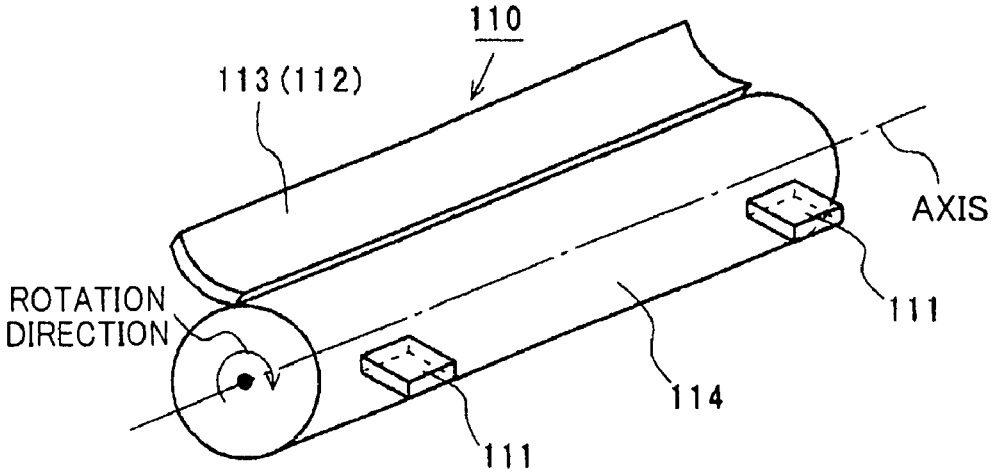
PRIOR ART FIG.12
FIG. 12 is a perspective-view diagram illustrating a mounted state of a toner removing blade in a conventional image forming apparatus.

FIG. 10 illustrates a modification of the way in which the toner removing blades 60 and 61 are mounted. As illustrated in FIG. 10, in the toner removing blades 60 and 61, the upstream-side end faces 62*c* and 64*c* of the rubber blades 62 and 64 along the rotation direction of the photosensitive drum 40 slant obliquely relative to the axis of the photosensitive drum 40 in such a manner that the rubber blade 62 and the rubber blade 64 form a substantially reverse-v shape. The toner scraped off the surface of the photosensitive drum 40 slides down toward the contact regions of the cleaning blade 50 and the photosensitive drum 40, at inner side positions of the second inner faces 56*b* of the first seal portions 54*a* (FIG. 8).

In FIG. 10, specifically, a corner 62*d* of the rubber blade 62 at which the inner face 62*a* and the upstream-side end face 62*c* intersect each other (i.e. an inner end and an upstream-side corner along the rotation direction of the photosensitive drum 40) is positioned at downstream side of a corner 62*e* of the rubber blade 62 at which the outer face 62*b* and the upstream-side end face 62*c* intersect each other (i.e. an outer end and an upstream-side corner along the rotation direction of the photosensitive drum 40) with respect to the rotational direction of the photosensitive drum 40.

In FIG. 10, also, a corner 64*d* of the rubber blade 64 at which the inner face 64*a* and the upstream-side end face 64*c* intersect each other (i.e. an inner end and an upstream-side corner along the rotation direction of the photosensitive drum 40) is positioned, with respect to the rotational direction of the photosensitive drum 40, at downstream side of a corner 64*e* of the rubber blade 64 at which the outer face 64*b* and the upstream-side end face 64*c* intersect each other (i.e. an outer end and an upstream-side corner along the rotation direction of the photosensitive drum 40).

In such a modification, all the toner scraped off by the ring removing blades 60 and 61 can be stored in the housing 52.

In the above-described embodiment and modification, the seal 54 is fixed to the opening 55 of the housing 52. However, that need not necessarily be the case, and the seal 54 may be omitted. In that case, the toner removing blades 60 and 61 can be arranged at a between the downstream side of the nip position 45 and the upstream side of the cleaning blade 50 in respect to a rotation direction of the photosensitive drum 40. In that case, moreover, the inner end 62*a* of the rubber blade 62 and the inner end 64*a* of the rubber blade 64 are disposed at the corresponding contact regions 57 of the cleaning blade 50 and the photosensitive drum 40. An image forming apparatus having the above features allows preventing that toner scraped off the surface of the photosensitive drum 40 should adhere again onto the photosensitive drum 40 within the effective development width region of the latter, and allows preventing the occurrence of uneven development.

In the above-described embodiment and modification, the upstream-side end faces 62*c* and 64*c* of the rubber blades 62 and 64 are flat-shaped, but their shape is not limited thereto, and may be of curved or uneven shape, or may include partial recesses where toner pockets may form.

Also, transfer may involve causing a sheet to run on the above-described intermediate transfer belt 22, such that toner images of respective colors are sequentially transferred onto the sheet. The transfer member is not limited to rollers, the intermediate transfer belt 22 or the like, and may be replaced by any alternative member that a person skilled in the art may devise.

In sum, a preferred aspect of the present invention is an image forming apparatus for forming a toner image based on an electrostatic latent image, comprising a photosensitive drum on the surface of which the electrostatic latent image is formed; a developing device that supplies toner to the photosensitive drum via a developing roller, and that forms a toner image on the surface of the photosensitive drum; a transfer member that forms a nip with the photosensitive drum; a spacer roller that is disposed concentrically with a rotation axis of the developing roller, that contacts with the photosensitive drum outside a running region of the transfer member, and that forms a predetermined gap between the developing roller and the photosensitive drum; a cleaning device that is positioned at downstream side of a nip position with respect to the rotational direction of the photosensitive drum, and that clean the toner remaining on the surface of the photosensitive drum; and a toner removing blade that is provided in the cleaning device, that is disposed between the downstream side of the nip position and the upstream side of the cleaning device, with respect to the rotational direction of the photosensitive drum, and that contacts with a contact region between the photosensitive drum and the spacer roller. The toner removing blade includes a contact portion that contacts with the contact region in such a manner that an inner end of the contact portion, which along the rotation axis of the photosensitive drum extends, is positioned within a toner collecting region in which toner is scraped off by the cleaning device.

In the above preferred aspect of the present invention, any toner that becomes adhered, ring-like, onto the contact region of the spacer roller and the photosensitive drum can be scraped off by the toner removing blade, the toner scraped off being then collected by the cleaning device disposed downstream of the toner removing blade. As a result, this allows preventing that toner scraped off the surface of the photosensitive drum should adhere again onto the photosensitive drum within an effective development width region of the latter, and allows preventing the occurrence of uneven development.

In a preferred aspect, wherein the cleaning device includes a housing in which the toner scraped off is collected and an elastic member which delimits an opening formed in the housing, said opening elongates along the rotation axis direction of the photosensitive drum so that the toner scraped off is collected therethrough.

In another preferred aspect, the inner end of the contact portion is positioned at inner side of the opening along the rotation axis direction of the photosensitive drum.

In another preferred aspect, the housing is provided at one of the upstream and downstream sides in respect to the rotational direction of the photosensitive drum with a cleaning blade that delimits an edge of the opening along a longitudinal direction thereof, and a seal that delimits both side edges of the opening and a longitudinal-direction edge of the opening which is opposite to the cleaning blade in the width direction of the opening.

In another preferred aspect, the seal has integrally: a pair of first seal portions that are disposed at both ends of the rotation axis direction of the photosensitive drum and that delimit the side edges of the opening; and a second seal portion that is disposed on the other of the upstream and downstream sides in respect to a rotation direction of the photosensitive drum, and the second seal portion extends along the rotation axis direction of the photosensitive drum so as to connect end portions of the two first seal portions delimits a longitudinal-direction edge of the opening opposite the cleaning blade in the width direction of the opening.

In another preferred aspect, the contact portion of the toner removing blade has a substantially quadrangular planar shape.

In another preferred aspect, an end face of the contact portion of the toner removing blade, on the upstream side in the rotation direction of the photosensitive drum, extends along the rotation axis of the photosensitive drum.

In another preferred aspect, the contact portion of the toner removing blade slants obliquely relative to the rotation axis of the photosensitive drum in such a manner that an upstream-inner corner of the contact portion, where an inner face of the contact portion intersects an upstream-side end face thereof, is positioned downstream side of an upstream-outer corner of the contact portion with respect to the rotational direction of the photosensitive drum, where an outer face of the contact portion intersects the upstream-side end face thereof.

The above embodiments are merely preferred specific embodiments of the present invention, which is in no way limited to the embodiments described above. It goes without saying that numerous modifications can be made to the embodiments without departing from the scope of the invention as set forth in the appended claims.

This application is based on Japanese Patent Application Serial No. 2008-113619, filed in Japan Patent Office on Apr. 24, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus for forming a toner image based on an electrostatic latent image, comprising:

a photosensitive drum with a surface on which the electrostatic latent image is formed;

a developing device that supplies toner to the photosensitive drum via a developing roller, and that forms a toner image on the surface of the photosensitive drum;

a transfer member that forms a nip with the photosensitive drum;

a spacer roller that is disposed concentrically with a rotation axis of the developing roller, that contacts with the photosensitive drum outside a running region of the transfer member, and that forms a predetermined gap between the developing roller and the photosensitive drum;

a cleaning device that is positioned at downstream side of a nip position with respect to the rotational direction of the photosensitive drum, and that clean the toner remaining on the surface of the photosensitive drum; and a toner removing blade that is provided in the cleaning device, that is disposed between downstream side of the nip position and upstream side of the cleaning device with respect to the rotational direction of the photosensitive drum, and that contacts with a contact region between the photosensitive drum and the spacer roller, wherein the toner removing blade includes a contact portion that contacts with the contact region in such a manner that an inner end of the contact portion, which along the rotation axis of the photosensitive drum extends, is positioned within a toner collecting region in which toner is scraped off by the cleaning device, and wherein the contact portion of the toner removing blade slants obliquely relative to the rotation axis of the photosensitive drum in such a manner that an upstream-inner corner of the contact portion is positioned downstream side of an upstream-outer corner of the contact portion with respect to the rotational direction of the photosensitive drum, where an inner face of the contact portion intersects an upstream-side end face thereof and an outer face of the contact portion intersects the upstream-side end face thereof.

2. An image forming apparatus according to claim 1, wherein the cleaning device includes a housing in which the toner scraped off is collected and an elastic member which delimits an opening formed in the housing, said opening elongates along the rotation axis direction of the photosensitive drum so that the toner scraped off is collected therethrough.

3. An image forming apparatus according to claim 2, wherein the inner end of the contact portion is positioned at inner side of the opening along the rotation axis direction of the photosensitive drum.

4. An image forming apparatus according to claim 2, wherein the housing is provided at one of the upstream and downstream sides in respect to the rotational direction of the photosensitive drum with a cleaning blade that delimits an edge of the opening along a longitudinal direction thereof; and a seal that delimits both side edges of the opening and a longitudinal-direction edge of the opening which is opposite to the cleaning blade in the width direction of the opening.

5. An image forming apparatus according to claim 4, wherein the seal has integrally: a pair of first seal portions that are disposed at both ends of the rotation axis direction of the photosensitive drum and that delimit the side edges of the opening; and a second seal portion that is disposed on the other of the upstream and downstream sides in respect to a rotation direction of the photosensitive drum, and the second seal portion extends along the rotation axis direction of the photosensitive drum so as to connect end portions of the two first seal portions delimits a longitudinal-direction edge of the opening opposite the cleaning blade in the width direction of the opening.

6. An image forming apparatus according to claim 1, wherein the contact portion of the toner removing blade has a substantially quadrangular planar shape.

7. An image forming apparatus according to claim 1, wherein an end face of the contact portion of the toner removing blade, on the upstream side in the rotation direction of the photosensitive drum, extends along the rotation axis of the photosensitive drum.

* * * * *